US008561690B2

(12) United States Patent
Hazelip

(10) Patent No.: US 8,561,690 B2
(45) Date of Patent: Oct. 22, 2013

(54) EXPANSION CONE ASSEMBLY FOR SETTING A LINER HANGER IN A WELLBORE CASING

(75) Inventor: Gary Lynn Hazelip, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 89 days.

(21) Appl. No.: 13/040,668

(22) Filed: Mar. 4, 2011

(65) Prior Publication Data

US 2012/0222868 A1 Sep. 6, 2012

(51) Int. Cl.
*E21B 23/00* (2006.01)

(52) U.S. Cl.
USPC ..... 166/208; 166/209; 166/207; 166/382

(58) Field of Classification Search
USPC ..... 166/207–209, 216, 217, 382–384; 72/58, 72/370.01, 370.08, 393; 29/522.1, 523
See application file for complete search history.

(56) References Cited

U.S. PATENT DOCUMENTS 5,318,131 A 6/1994 Baker
6,739,398 B1 5/2004 Yokley et al.
7,128,146 B2 * 10/2006 Baugh et al. ..... 166/206
7,896,085 B2 * 3/2011 Nutley et al. ..... 166/380
2003/0098164 A1 5/2003 Hirth
2004/0231855 A1 11/2004 Cook et al.
2005/0006106 A1 1/2005 Hirth et al.
2006/0090902 A1 5/2006 Costa et al.
2008/0135261 A1 6/2008 McGilvray et al.
2009/0107686 A1 * 4/2009 Watson ..... 166/381

OTHER PUBLICATIONS

ISR & WO; PCT/US2012/025566; KIPO; Apr. 23, 2012.

* cited by examiner

*Primary Examiner* — Yong-Suk (Philip) Ro
(74) *Attorney, Agent, or Firm* — Lawrence R. Youst

(57) ABSTRACT

An expansion cone assembly (200) for setting a liner hanger. The expansion cone assembly (200) includes a cone mandrel (202) having an outer frustoconical surface (220), a lead cone (206) slidably disposed around the cone mandrel (200) having a frustoconical surface (228) with a maximum outer diameter (230) and a collapsible cone (204) slidably disposed at least partially around the outer frustoconical surface (220) of the cone mandrel (202). In an expansion configuration, the outer frustoconical surface (220) radially props the collapsible cone (204) such that it has a first maximum outer diameter (232) that is greater than the maximum outer diameter (230) of the lead cone (206). In a retrieval configuration, the collapsible cone (204) axially shifts relative to the outer frustoconical surface (220) such that it has a second maximum outer diameter (234) that is no more than the maximum outer diameter (230) of the lead cone (206).

18 Claims, 12 Drawing Sheets

EXPANSION CONE ASSEMBLY FOR SETTING A LINER HANGER IN A WELLBORE CASING

FIELD OF THE INVENTION

This invention relates, in general, to equipment utilized in conjunction with operations performed in subterranean wells and, in particular, to an expansion cone assembly for setting a liner hanger in a subterranean wellbore having a casing string previously installed therein.

BACKGROUND OF THE INVENTION

Without limiting the scope of the present invention, its background is described with reference to constructing a subterranean well, as an example.

In conventional practice, the drilling of an oil or gas well involves creating a wellbore that traverses numerous subterranean formations. For a variety reasons, each of the formations through which the well passes is preferably isolated. For example, it is important to avoid an undesired passage of formation fluids into the wellbore and an undesired passage of wellbore fluids into a formation. In addition, it is important to prevent fluids from producing formations to enter or contaminate non producing formations.

To avoid these problems, conventional well architecture includes the installation of heavy steel casing within the wellbore. In addition to providing the isolating function, the casing also provides wellbore stability to counteract the geomechanics of the formations such as compaction forces, seismic forces and tectonic forces, thereby preventing the collapse of the wellbore wall.

In typical wellbore construction, after an upper portion of a well has been drilled and a casing string installed therein, drilling recommences to extend the well to the next desired depth. In order to allow passage of the drill bit and other tools through the previously installed casing string, each successive section of the well is drilled with a smaller diameter than the previous section. In addition, each succeeding casing string placed in the wellbore has an outside diameter smaller than that of the previously installed casing string.

The casing strings are generally fixed within the wellbore by a cement layer between the outer wall of the casing and the wall of the wellbore. When a casing string is located in its desired position in the well, a cement slurry is pumped via the interior of the casing, around the lower end of the casing and upwards into the annulus. As soon as the annulus around the casing is sufficiently filled with the cement slurry, the cement slurry is allowed to harden. The cement sets up in the annulus, supporting and positioning the casing and forming a substantially impermeable barrier.

In one approach, each casing string extends downhole from the surface such that only a lower section of each casing string is adjacent to the wellbore wall. Alternatively, the wellbore casings may include one or more liner strings which do not extend to the surface of the wellbore but instead typically extend from near the bottom end of a previously installed casing downward into the uncased portion of the wellbore. Liner strings are typically lowered downhole on a work string that may include a running tool that attaches to the liner string. The liner string typically includes a liner hanger at its uphole end that is mechanically or hydraulically set. In one example, an expansion cone is passed downwardly through the liner hanger to radially expand and plastically deform the liner hanger into sealing and gripping engagement with the previously installed casing string.

It has been found, however, that once the expansion cone has passed through and plastically deformed the liner hanger, resilience in the casing string and the liner hanger may result in a reduction in the inner diameter of the liner hanger. When such inner diameter reduction occurs, retrieval of the expansion cone back through the previously set liner hanger may be difficult. Accordingly, a need has arisen for an expansion cone that is operable to plastically deform the liner hanger into sealing and gripping engagement with the casing string. A need has also arisen for such an expansion cone that is operable to be retrieved through the liner hanger even after resilience in the casing string or the liner hanger reduces the inner diameter of the liner hanger after setting.

SUMMARY OF THE INVENTION

The present invention disclosed herein is directed to an expansion cone assembly for setting a liner hanger in a subterranean wellbore having a casing string previously installed therein. The expansion cone assembly of the present invention utilizes a dual cone configuration including a collapsible cone that is operable to plastically deform the liner hanger into sealing and gripping engagement with the casing string. In addition, expansion cone assembly of the present invention is operable to be retrieved through the liner hanger even after resilience in the casing string or the liner hanger reduces the inner diameter of the liner hanger after setting.

In one aspect, the present invention is directed to an expansion cone assembly for setting a liner hanger. The expansion cone assembly includes a cone mandrel having an outer frustoconical surface, a lead cone slidably disposed around the cone mandrel and having an outer frustoconical surface with a maximum outer diameter and a collapsible cone slidably disposed at least partially around the outer frustoconical surface of the cone mandrel. In an expansion configuration, the outer frustoconical surface of the cone mandrel radially props the collapsible cone such that the collapsible cone has a first maximum outer diameter that is greater than the maximum outer diameter of the lead cone. In a retrieval configuration, the collapsible cone axially shifts relative to the outer frustoconical surface of the cone mandrel such that the collapsible cone has a second maximum outer diameter that is no more than the maximum outer diameter of the lead cone.

In one embodiment, the cone mandrel has an outer cylindrical surface and the lead cone is slidably disposed at least partially around the outer cylindrical surface of the cone mandrel. In another embodiment, the lead cone is slidably disposed at least partially around the outer frustoconical surface of the cone mandrel. In some embodiments, the lead cone and the collapsible cone are adjacent to one another. In certain embodiments, the collapsible cone includes a slotted assembly having radially shiftable segments. In this embodiment, the radially shiftable segments of the collapsible cone are radially propped by the outer frustoconical surface of the cone mandrel when the expansion cone assembly is in the expansion configuration.

In one embodiment, the lead cone and the collapsible cone axially shift together relative to the outer frustoconical surface of the cone mandrel when the expansion cone assembly is operated from the expansion configuration to the retrieval configuration. In another embodiment, the cone mandrel has an end cap that limits axially travel of the lead cone when the expansion cone assembly is operated from the expansion configuration to the retrieval configuration.

In another aspect, the present invention is directed to a method for setting a liner hanger. The method includes operably associating a setting tool having an expansion cone assembly with a liner string including the liner hanger, lowering the setting tool and the liner string into a wellbore casing, applying a force in the downhole direction to the expansion cone assembly such that a lead cone and a collapsible cone of the expansion cone assembly radially expand at least a portion of the liner hanger into contact with the wellbore casing, the collapsible cone having a first maximum diameter that is larger than a maximum outer diameter of the lead cone, decoupling the setting tool from the liner string, applying a force in the uphole direction to the expansion cone assembly and axially shifting the lead cone and the collapsible cone relative to an outer frustoconical surface of a cone mandrel such that the collapsible cone has a second maximum outer diameter that is no more than the maximum outer diameter of the lead cone.

In a further aspect, the present invention is directed to an expandable liner hanger system. The system includes a liner string having a liner hanger disposed at an uphole end thereof, a setting tool operably associate with the liner hanger and an expansion cone assembly operably associated with the setting tool. The expansion cone assembly includes a cone mandrel having an outer frustoconical surface, a lead cone slidably disposed around the cone mandrel and having an outer frustoconical surface with a maximum outer diameter and a collapsible cone slidably disposed at least partially around the outer frustoconical surface of the cone mandrel. In an expansion configuration, the outer frustoconical surface of the cone mandrel radially props the collapsible cone such that the collapsible cone has a first maximum outer diameter that is greater than the maximum outer diameter of the lead cone. In a retrieval configuration, the collapsible cone axially shifts relative to the outer frustoconical surface of the cone mandrel such that the collapsible cone has a second maximum outer diameter that is no more than the maximum outer diameter of the lead cone.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
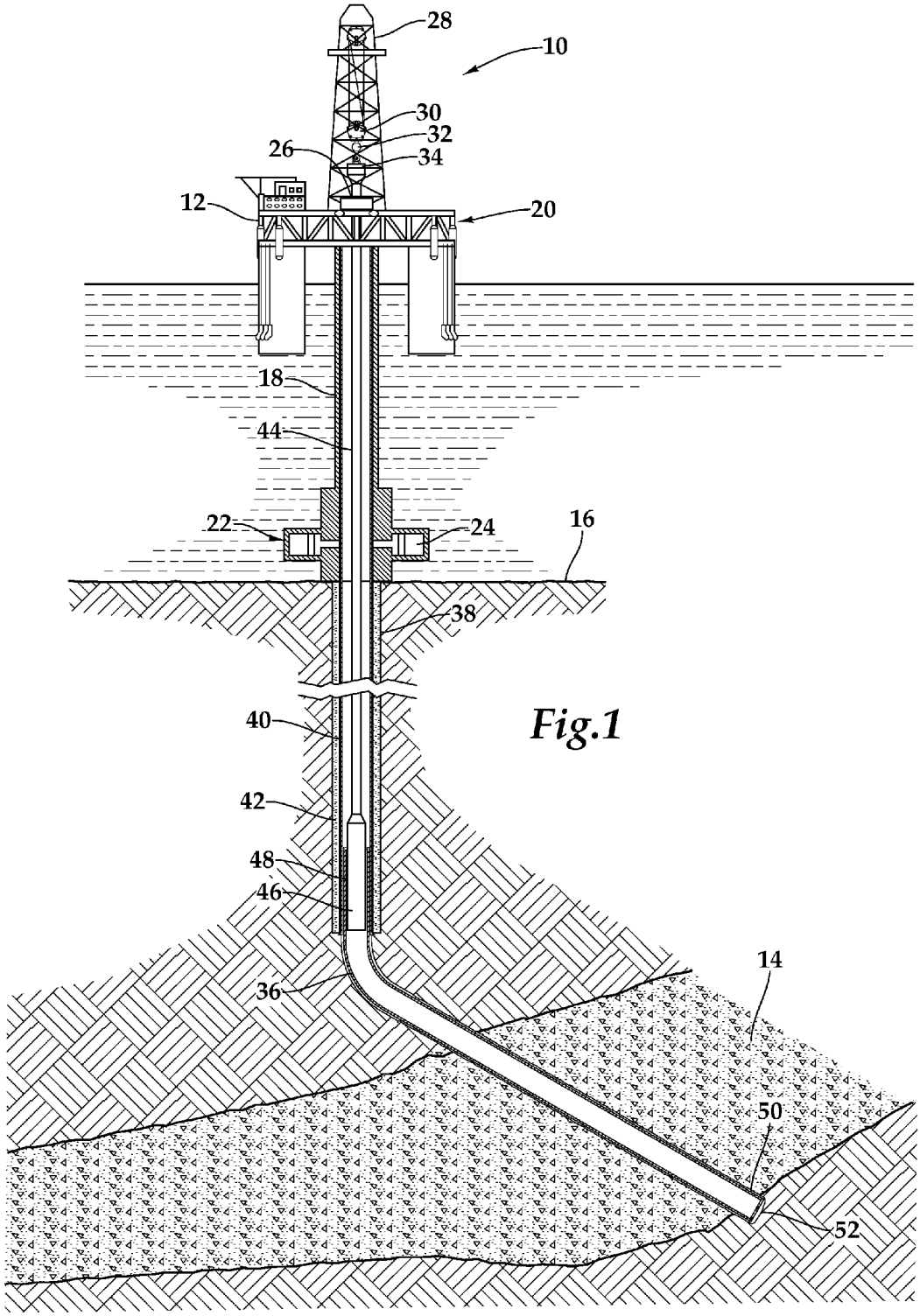
FIG. 1 is a schematic illustration of an offshore oil and gas platform installing a liner string in a casing string previously installed in a subterranean wellbore according to an embodiment of the present invention.

Referring initially to FIG. 1, an apparatus for installing a liner string in a casing string previously installed in a subterranean wellbore being deployed from an offshore oil or gas platform is schematically illustrated and generally designated 10. A semi-submersible platform 12 is centered over submerged oil and gas formation 14 located below sea floor 16. A subsea conduit 18 extends from deck of platform 12 to wellhead installation 22, including blowout preventers 24. Platform 12 has a hoisting apparatus 26, a derrick 28, a travel block 30, a hook 32 and a swivel for raising and lowering pipe strings, such as a liner string 36.

A wellbore 38 extends through the various earth strata including formation 14. An upper portion of wellbore 38 includes casing 40 that is cemented within wellbore 38 by cement 42. Disposed within the lower portion of wellbore 38 is liner string 36. Liner string 36 is being lowered downhole on a work string 44 that includes a setting tool 46 that attaches work string 44 to liner string 36. Liner string 36 includes a liner hanger 48 at its uphole end that is operable to be hydraulically set by passing an expander cone of setting tool 46 through liner hanger 48 to radially expand and plastically deform liner hanger 48 into sealing and gripping engagement with casing string 40. As shown, liner string 36 is positioned in wellbore 38 such that the downhole end 50 of liner string 36 extends to close proximity to the bottom 52 of wellbore 38.

Even though FIG. 1 depicts a slanted wellbore, it should be understood by those skilled in the art that the apparatus for installing a liner string in a casing string previously installed in a subterranean wellbore of the present invention is equally well suited for use in wellbores having other orientations including vertical wellbores, horizontal wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the uphole direction being toward the top or the left of the corresponding figure and the downhole direction being toward the bottom or the right of the corresponding figure. Also, even though FIG. 1 depicts an offshore operation, it should be understood by those skilled in the art that the apparatus for installing a liner string in a casing string previously installed in a subterranean wellbore of the present invention is equally well suited for use in onshore operations.

Referring next to FIGS. 2A-2H, therein is depicted an apparatus or setting tool 100 for installing a liner string in a casing string 40 previously installed in a subterranean wellbore 38. Apparatus 100 is used to run a liner string 102 downhole. Liner string 102 includes a plurality of substantially tubular sections that are preferably formed from jointed tubulars that are threadably coupled together at the surface. In the illustrated embodiment, liner string 102 includes a tie back receptacle 104, a liner hanger 106 and any desired number of liner tubulars 108 such that liner string 102 will extend past the end of casing string 40 and substantially to the bottom of wellbore 38.

Figure 2A:
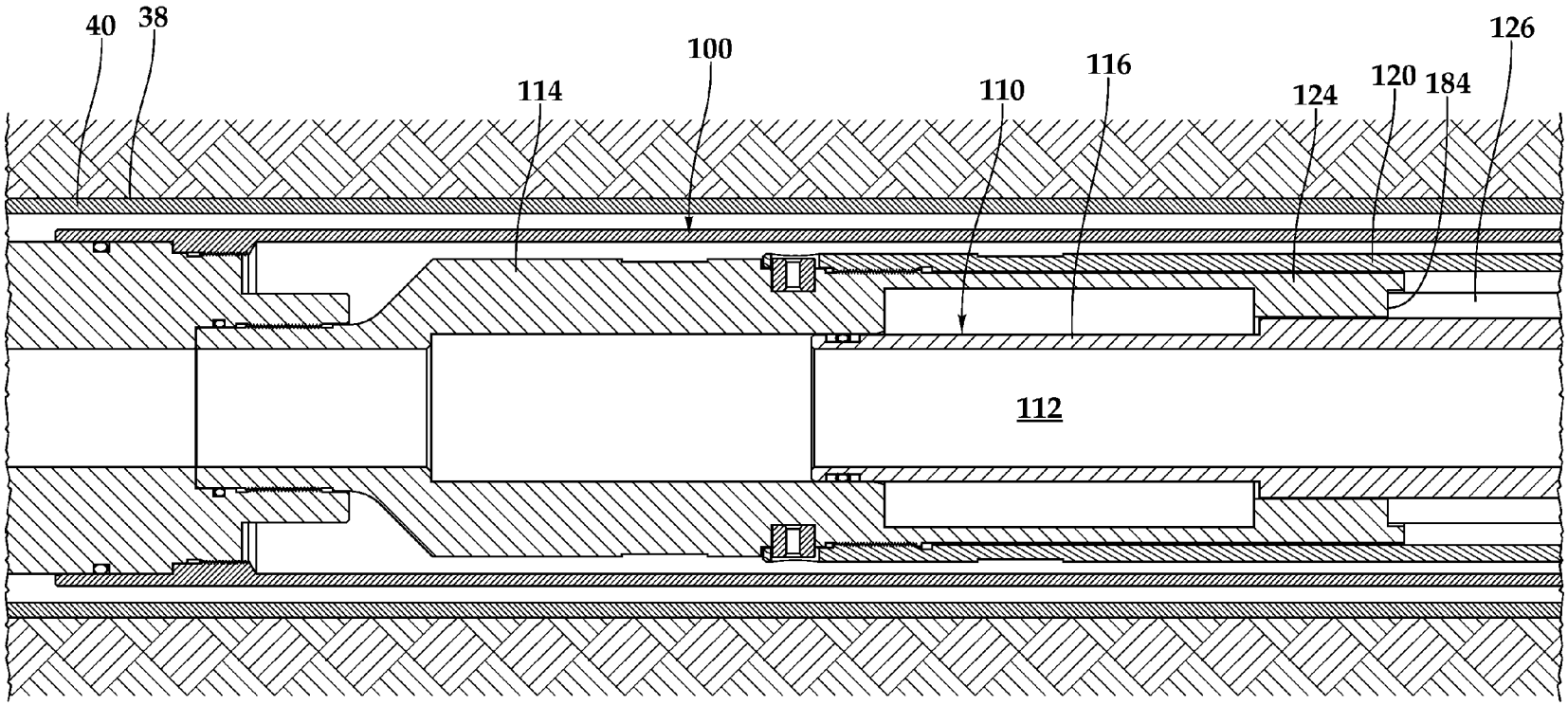
FIGS. 2A-2H are cross sectional views of consecutive axial sections of an apparatus for installing a liner string in a casing string previously installed in a subterranean wellbore according to an embodiment of the present invention.

Apparatus 100 is positioned at least partially within liner string 102 and is operable to transport, apply downward force on and set liner string 102 in the well. Apparatus 100 includes a plurality of substantially tubular members that may be referred to as a tubular mandrel subassembly 110 that cooperate together to form a central bore 112 extending throughout. Tubular mandrel subassembly 110 includes an upper body 114 that may be threadably and sealingly coupled to other components of the work string at its upper end. Upper body 114 is slidably and sealing coupled to an inner mandrel assembly 116 that extends to the lower end of apparatus 100. Inner mandrel assembly 116 is formed from a plurality of sections that are threadably and sealingly coupled together by connectors 118. Inner mandrel assembly 116 may be threadably and sealingly coupled to other components of the work string at its lower end. An outer sleeve 120 is threadably coupled to upper body 114 and includes a lower receiver 122 that is positioned around inner mandrel assembly 116. Upper body 114 includes a plurality of lugs 124 that cooperate with a slot profile 126 of inner mandrel assembly 116, as best seen in FIG. 2A.

Figure 2B:
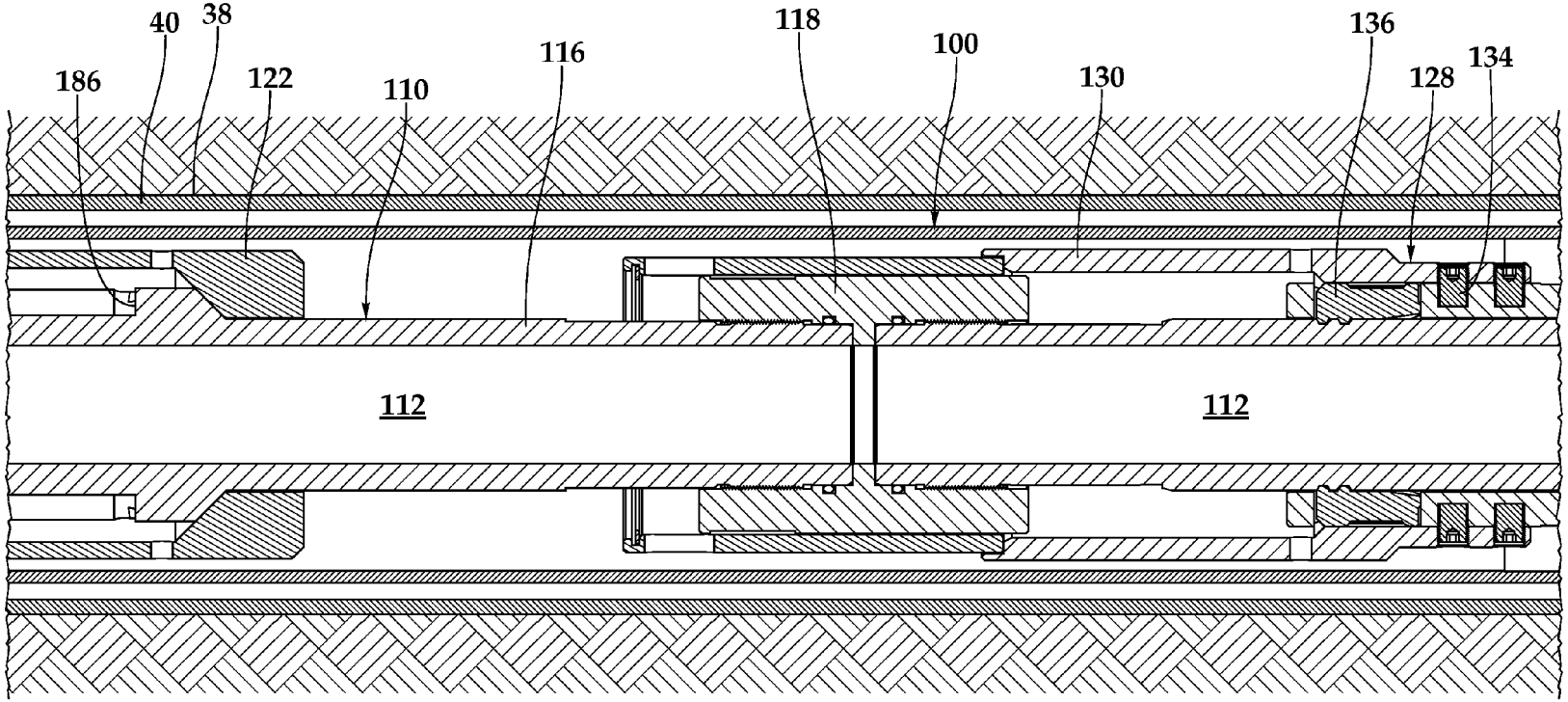
Figure 2C:
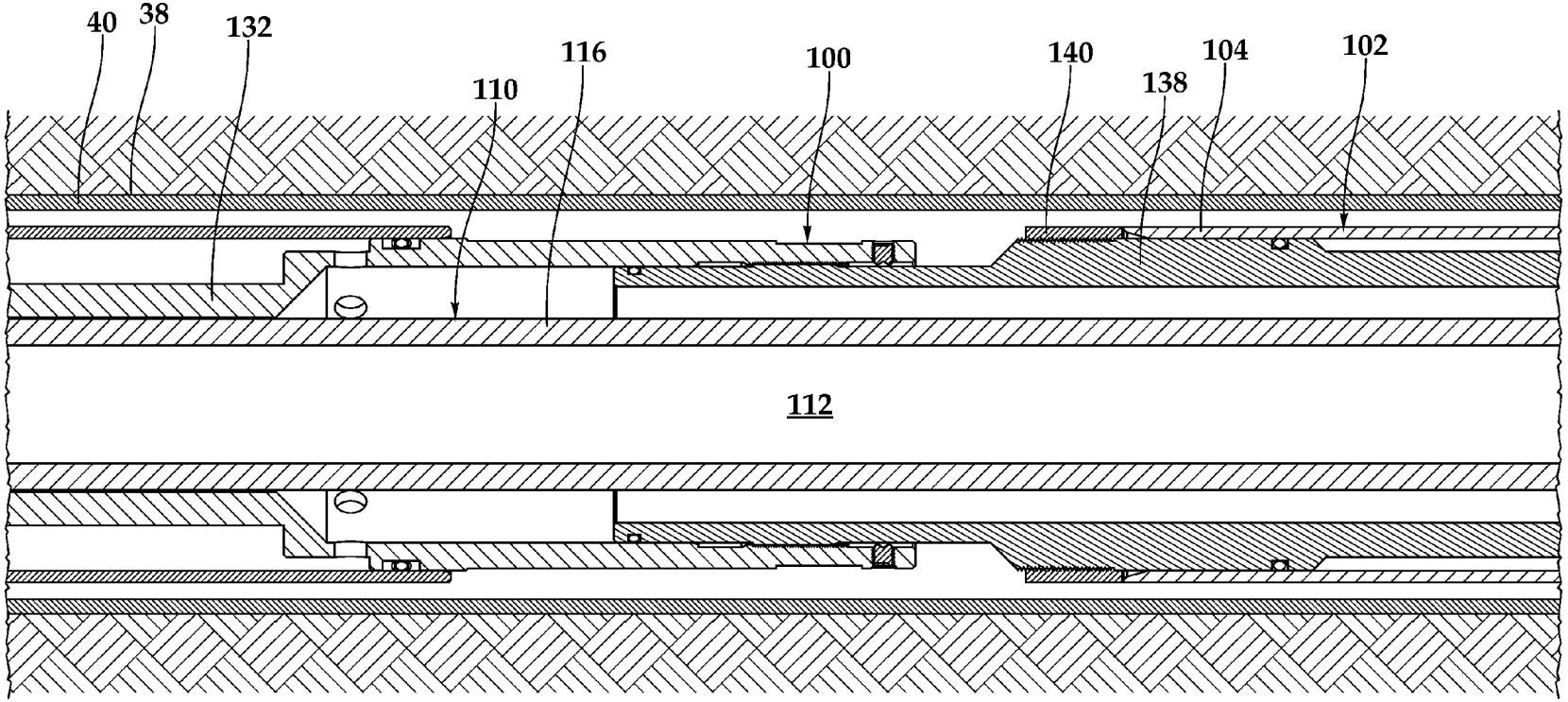

Setting tool 100 has a release subassembly 128, as best seen in FIG. 2B, including a prop sleeve 130 that is secured to an outer mandrel extension 132 by a plurality of shear pins 134. Outer mandrel extension 132 is securably coupled to inner mandrel assembly 116 by a plurality of dogs 136. As best seen in FIG. 2C, outer mandrel extension 132 is threadably coupled to outer mandrel 138 which is sealing received within tie back receptacle 104. A load transfer subassembly depicted as a ring 140 having shearable threads is threadably positioned about outer mandrel 138 and against the top of tie back receptacle 104.

Figure 2D:
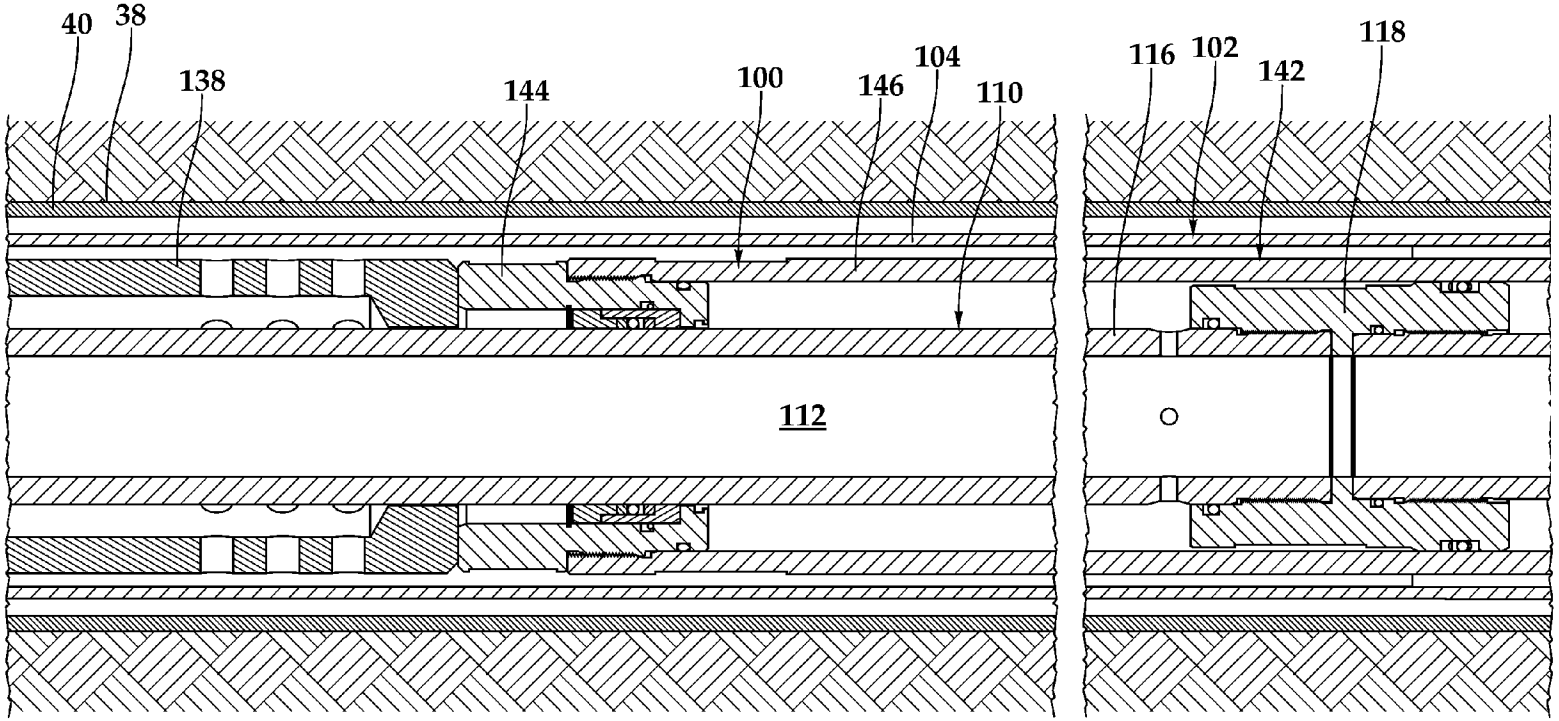
Figure 2E:
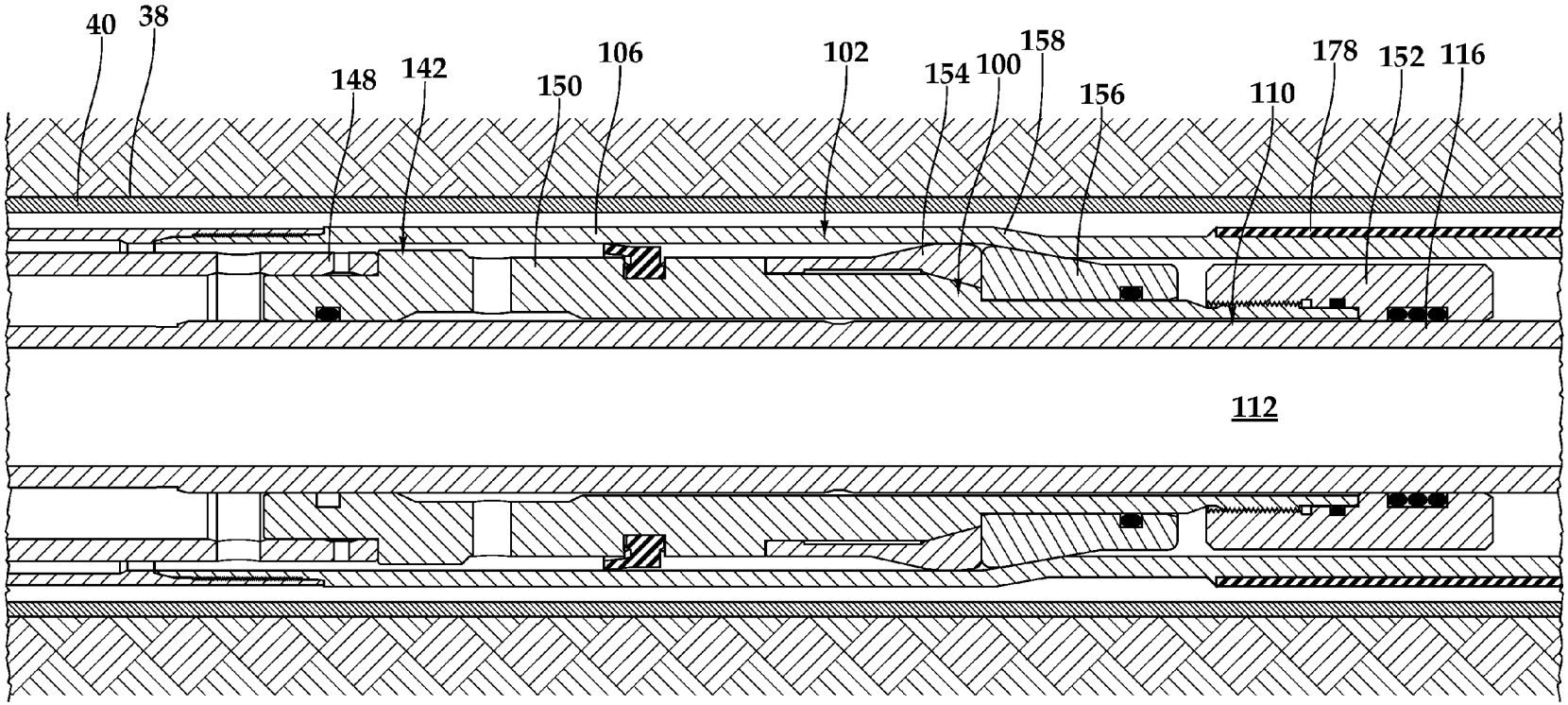

As best seen in FIGS. 2D-2E, setting tool 100 has an expansion cone drive subassembly 142 that includes a piston 144, a drive sleeve 146, a support ring 148, a cone mandrel 150, an end cap 152, a collapsible cone 154 and a lead cone 156. Lead cone 156 has a frustoconical shape having a first outer diameter that is smaller than the inner diameter of liner hanger 106 and a second outer diameter that is larger than the inner diameter of liner hanger 106. Collapsible cone 154 has an outer surface that has an outer diameter that is larger than the second outer diameter of lead cone 156. Together, collapsible cone 154 and lead cone 156 may be referred to as a dual cone assembly. Together, cone mandrel 150, collapsible cone 154 and lead cone 156 may be referred to as an expansion cone assembly. Collapsible cone 154 and lead cone 156 are initially received in a cone launcher portion 158 of liner hanger 106, where the inner diameter of liner hanger 106 is large enough to accept collapsible cone 154 and lead cone 156 without having been radially expanded.

Figure 2F:
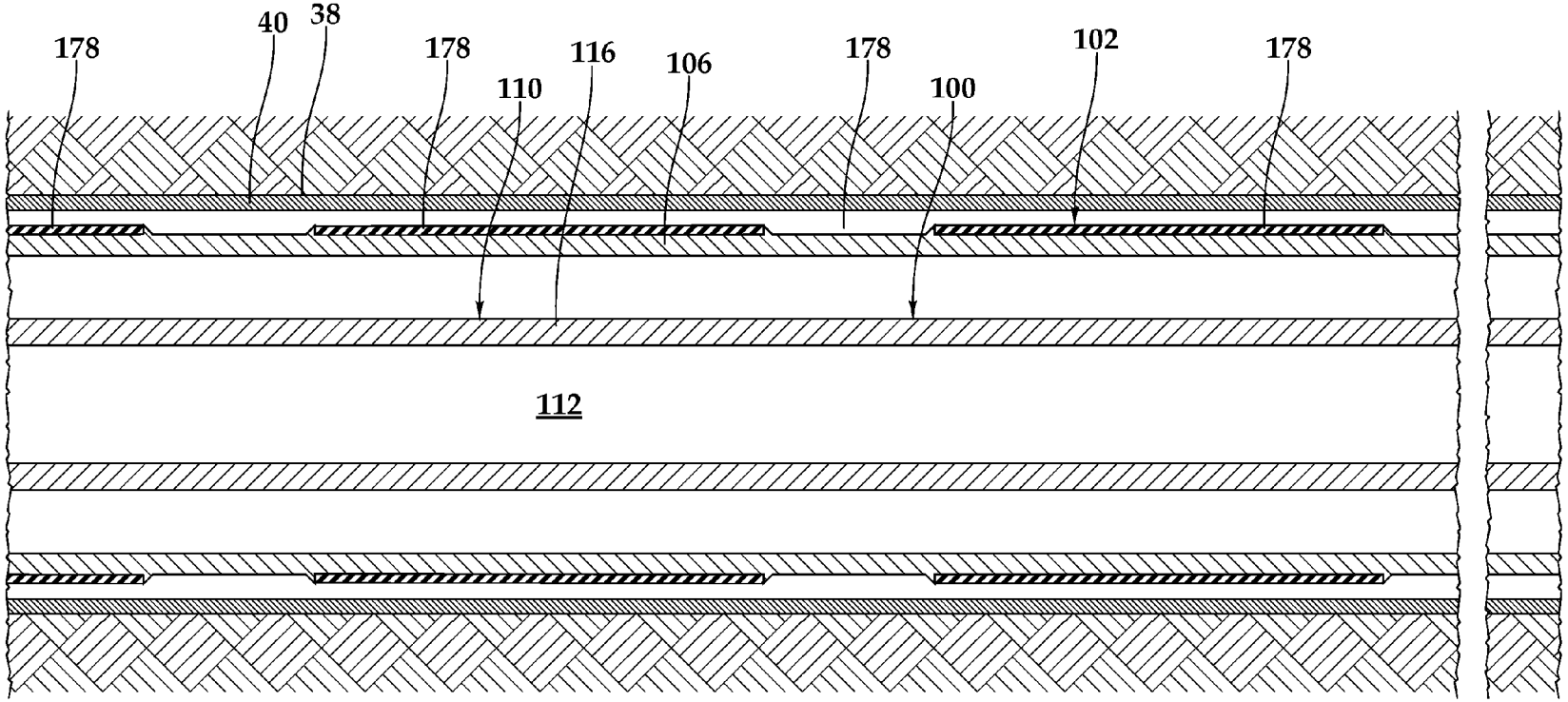
Figure 2G:
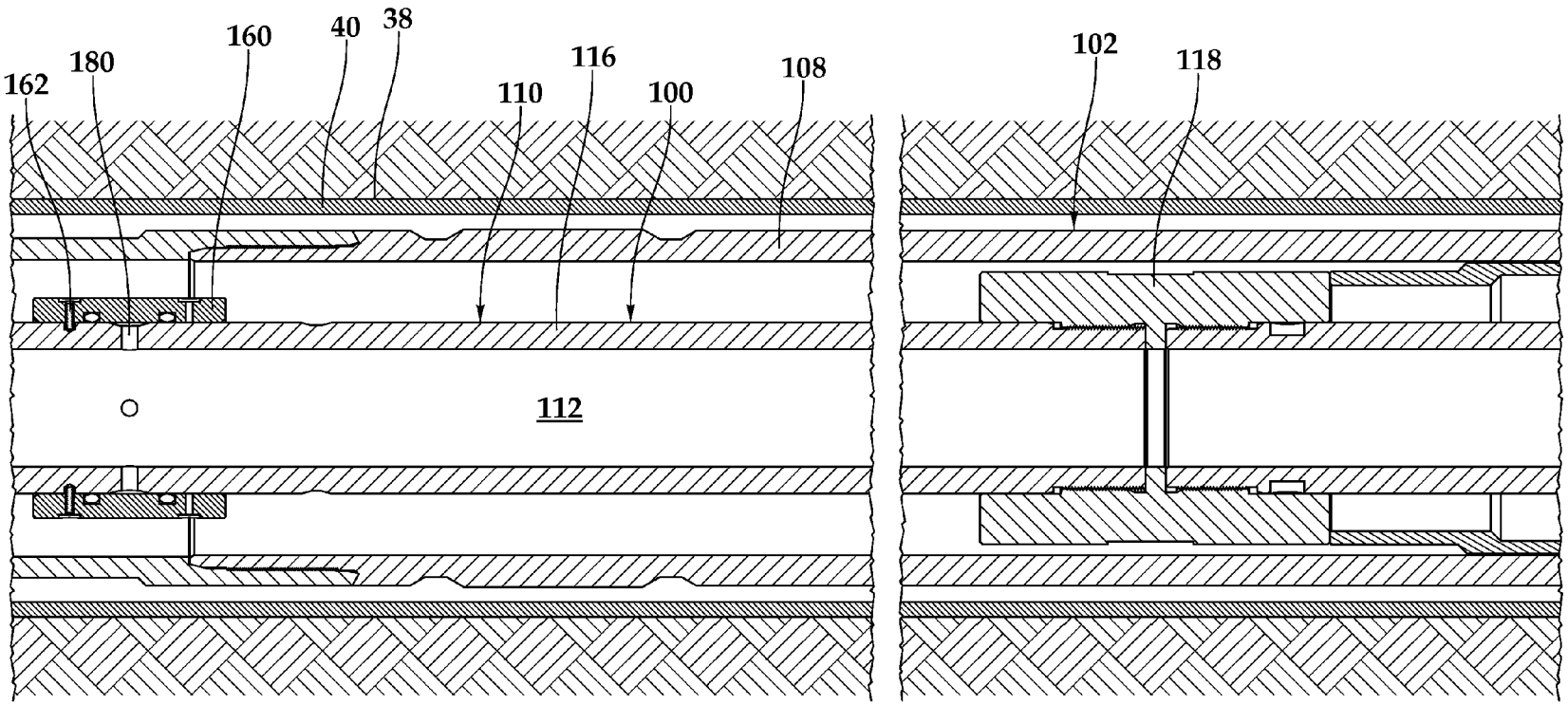

As best seen in FIG. 2G, a bypass sleeve 160 is securably connected to inner mandrel assembly 116 by one or more shear pins 162. As best seen in FIG. 2F, setting tool 100 has a collet subassembly 164 that includes a retainer 166, dogs 168, a garter spring 170 and a collet assembly 172. Collet assembly 172 cooperates with a mating profile 174 of liner string 102 and is supported within mating profile 174 by a radially expanded portion or prop 176 of inner mandrel assembly 116.

In operation, setting tool 100 is used to install liner string 102 in casing string 40. Importantly, this is achieved without risk of getting the expansion cone assembly stuck in liner hanger 106 after setting liner hanger 106 within casing string 40 due to inner diameter reduction of liner hanger 106 caused, for example, by reliance in liner hanger 106, casing string 40 or both. Specifically, the use of the expansion cone assembly of the present invention enables selective diameter reduction of collapsible cone 154, thereby preventing sticking of the expansion cone assembly within liner hanger 106 after liner hanger 106 has been set.

In the illustrated embodiment, as liner string 102 is being run downhole via work string 44, significant force may be required to push liner string 102 to its desired location, particularly in deviated, horizontal or multilateral wellbores. The force from the surface is applied through work string 44 to upper body 114. In the running configuration of setting tool 100, upper body 114 applies the downward force to inner mandrel assembly 116 via lugs 124 and slot profile 126. This downhole force is transferred from inner mandrel assembly 116 to outer mandrel 138 via dogs 136 and outer mandrel extension 132. The downhole force is then applied from outer mandrel 138 to tie back receptacle 104 of liner string 102 via load transfer subassembly 140, as best seen in FIG. 2C. Accordingly, the downhole force from work string 44 is applied to liner string 102 by load transfer subassembly 140 on tie back receptacle 104 without application of a downhole force by the expansion cone assembly.

Once liner string 102 is positioned in the desired location in wellbore 38, liner hanger 106 may be expanded. To expand liner hanger 106, the expansion cone assembly is driven downhole from cone launcher portion 158 through liner hanger 106 by the expansion cone drive subassembly 142. As the dual cone assembly passes through liner hanger 106 it radially expands and plastically deforms liner hanger 106. Preferably, the dual cone assembly is sized to radially expand and plastically deform liner hanger 106 such that the outer diameter of liner hanger 106 is pressed into gripping and sealing engagement with casing string 40. In the illustrated embodiment, liner hanger 106 includes a plurality of circumferential seals 178 to facilitate achieving a seal with casing string 40.

As discussed above, expansion cone drive subassembly 142 includes drive sleeve 146 that drives the expansion cone assembly through liner hanger 106. The uphole end of drive sleeve 146 initially abuts outer mandrel 138 that supports drive sleeve 146 against moving uphole relative to the inner mandrel assembly 116. Outer mandrel 138 is affixed to inner mandrel assembly 216 by dogs 136 via outer mandrel extension 132.

In the illustrated embodiment, drive sleeve 146 carries a single piston 144 that seals against inner mandrel assembly 116. Those skilled in the art will recognize that addition pistons could be used to multiply the hydraulic force applied to drive sleeve 146. Pressure applied to piston 144 moves drive sleeve 146 and thus the expansion cone assembly downhole. At the bottom of its stroke, expansion cone drive subassembly 142 impacts bypass sleeve 160 carried on inner mandrel assembly 116 causing shear pins 162 to shear and opening bypass ports 180 in inner mandrel assembly 116 equalizing pressure on piston 144.

After expanding liner hanger 106, setting tool 100 can be decoupled from liner string 102 and retrieved to the surface. As described above, force in the downhole direction applied from work string 44 is transferred to load transfer subassembly 140 which abuts tie back receptacle 104. In the illustrated embodiment, load transfer subassembly 140 is a ring that has shearable threads. Sufficient force in the downhole direction will cause the threads to shear off the ring which allows relative movement between mandrel subassembly 110 and liner string 102. Shifting of mandrel subassembly 110 downhole relative to liner string 102 unprops collet assembly 172 allowing collet assembly 172 to retract inward and release from mating profile 174, thereby releasing setting tool 100 from liner string 102. Thereafter, setting tool 100 may be withdrawn uphole from liner string 102 and out of the wellbore.

Figure 2H:
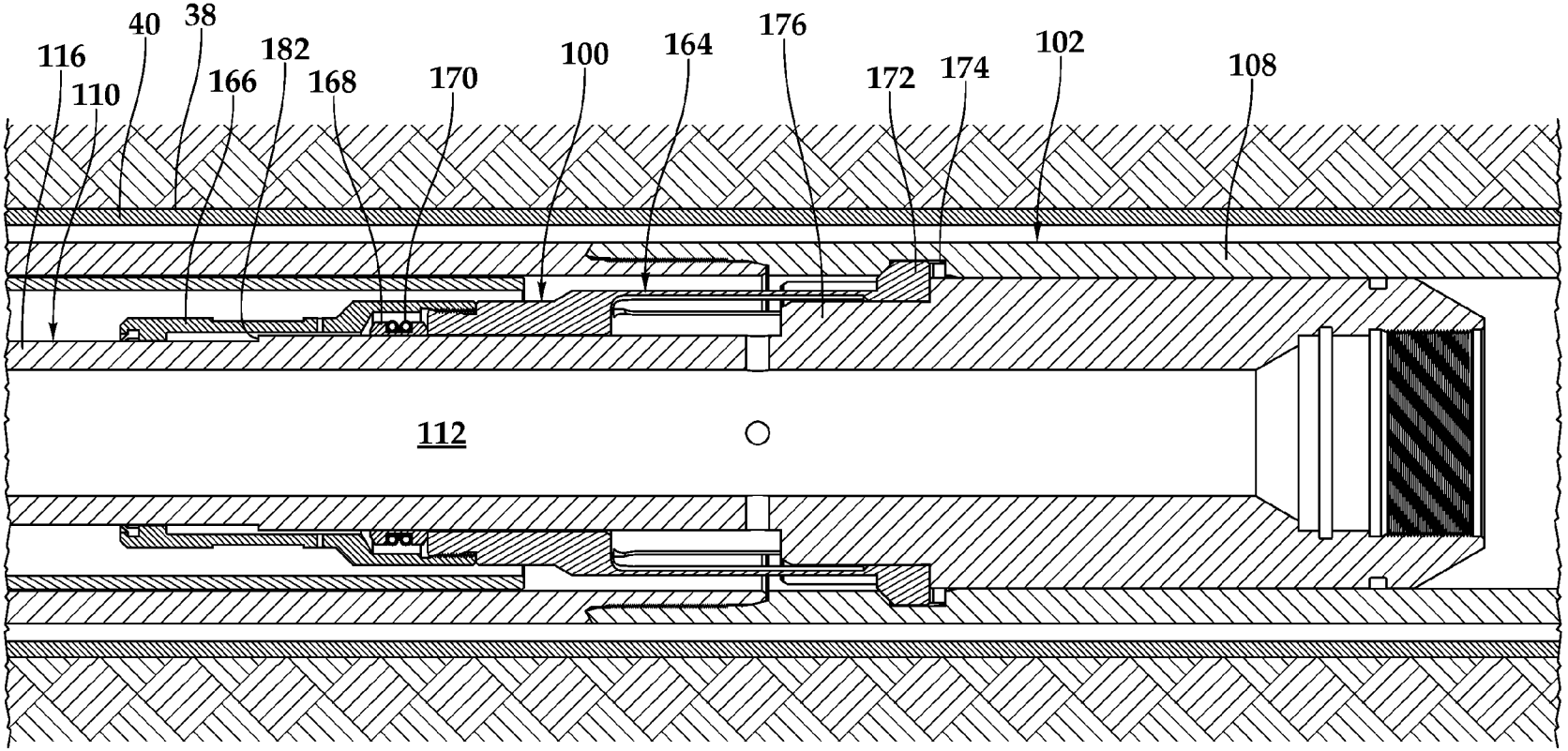

More specifically, as best seen in FIG. 2H, collet assembly 172 is radially supported into engagement with mating profile 174 via prop 176 during run in and expansion. Collet assembly 172 is released from engagement with mating profile 174 by moving prop 176 downhole relative to collet assembly 172. Further downhole movement of inner mandrel assembly 116 relative to collet subassembly 164 allows dogs 168 to retract into the radially reduced portion of inner mandrel assembly 116 due to the bias force of garter spring 170. Collet assembly 172 is prevented from shifting back downhole and reengaging with mating profile 174 as dogs 168 are prevented from moving past shoulder 182 by garter spring 170. In this configuration, setting tool 100 may be withdrawn uphole from liner string 102 and out of the wellbore. As described in greater detail below, setting tool 100 may be withdrawn uphole from liner string 102 without sticking the expansion cone assembly within liner hanger 106 as the dual cone assembly is operable to axially shift relative to cone mandrel 150 which enables collapsible cone 154 to radially contract. This radial contraction of collapsible cone 154 ensures that setting tool 100 may be withdrawn uphole from liner string 102 and out of the wellbore without sticking in liner hanger 106.

Alternatively, setting tool 100 may be released from liner string 102 without shearing load transfer subassembly 140 or prior to operating drive subassembly 142, if required. Specifically, application of a torsional force followed by application of a downhole force releases inner mandrel assembly 116 from liner string 102. As best seen in FIGS. 2A-2B, upper body 114 has inwardly protruding lugs 124 that operate within slot profile 126 of inner mandrel assembly 116. Slot profile 126 includes a plurality of slot pairs, each consisting of a long slot and a short slot of the type known to those skilled in the art as J-slots. The short slots of slot profile 126 define upper receptacles 184 and the long slots of slot profile 126 define lower receptacles 186. In the running configuration, lugs 124 are received in respective upper receptacles 184 and are operable to transmit a force in the downhole direction to inner mandrel assembly 116. When it is desired to decouple setting tool 100 from liner string 102, rotating upper body 114 dislodges lugs 124 from upper receptacles 184 and allows upper body 114 to move downhole relative to inner mandrel assembly 116 while lugs 124 traverse the long slots until received in respective lower receptacles 186.

When upper body 114 moves downhole relative to the inner mandrel assembly 116, it releases the inner mandrel assembly 116 from outer mandrel extension 132. As upper body 114 moves downhole, lower receiver 122 contacts release subassembly 128 and shears shear pins 134 retaining prop sleeve 130 to outer mandrel extension 132. Prop sleeve 130 supports dogs 136 that engage inner mandrel assembly 116 and affix outer mandrel assembly 132 relative to inner mandrel assembly 116. Thus, when desupported, dogs 136 release from inner mandrel assembly 116 and allow inner mandrel assembly 116 to move relative to release subassembly 128.

After inner mandrel assembly 116 is released from outer mandrel extension 132, upper body 114 acts upon inner mandrel assembly 116 to drive inner mandrel assembly 116 downhole relative to liner string 102. Driving inner mandrel assembly 116 downhole relative to liner hanger 102 moves prop 176 out of engagement with collet assembly 172, as described above, such that setting tool 100 may be withdrawn uphole from liner string 102 and out of the wellbore.

Figure 3:
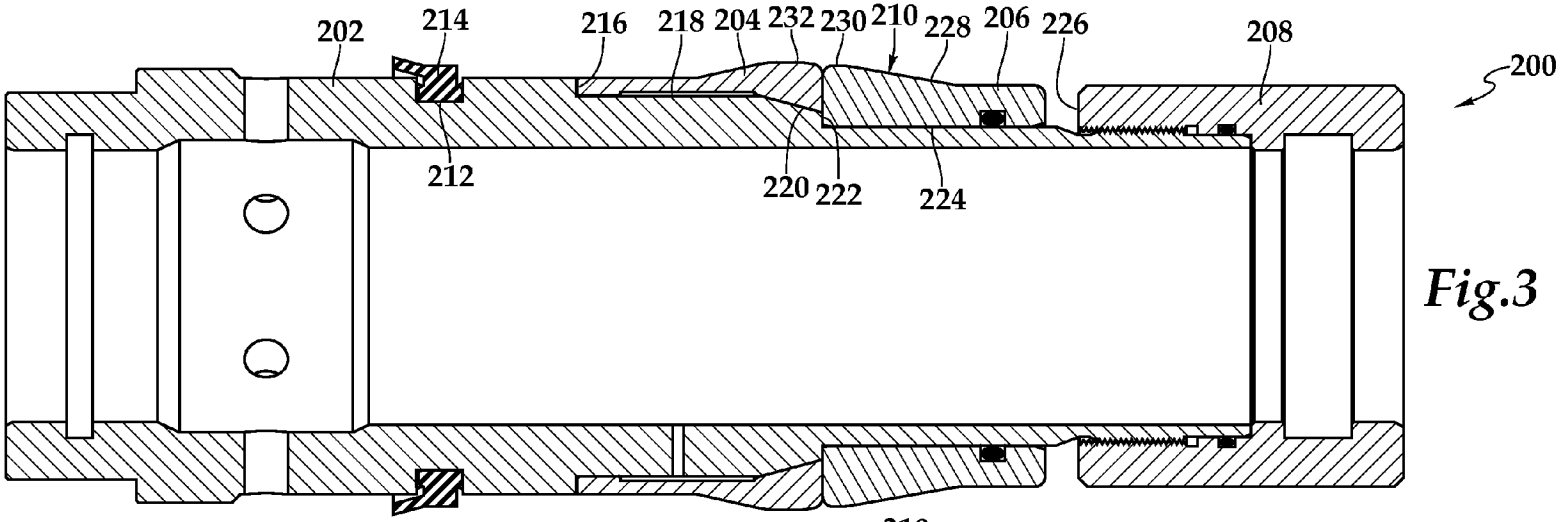
FIG. 3 is a cross sectional view of an expansion cone assembly for setting a liner hanger in a casing string according to an embodiment of the present invention in a first operational configuration.

Referring next to FIG. 3, therein is depicted an expansion cone assembly for setting a liner hanger in a casing string according to an embodiment of the present invention that is generally designated 200. Expansion cone assembly 200 includes a cone mandrel 202, a collapsible cone 204, a lead cone 206 and an end cap 208. As stated above, collapsible cone 204 and lead cone 206 may be referred to as a dual cone assembly 210. Cone mandrel 202 includes a circumferential groove 212 that is operable to receive a debris seal 214 therein. Preferably, debris seal 214 is operable to provide a seal with liner string 102 which may or may not be a fluid tight seal. Cone mandrel 202 also includes an upper shoulder 216 operable to limit the extent of upward travel of collapsible cone 204. Below upper shoulder 216, cone mandrel 202 has a cylindrical surface 218. Below cylindrical surface 218, cone mandrel 202 has an outer frustoconical surface 220. Preferably, outer frustoconical surface 220 has a ramp angle of between about ten degrees and about twenty degrees and most preferably about fifteen degrees. Cone mandrel 202 further includes a lower shoulder 222 operable to limit the extent of upward travel of lead cone 206. Below lower shoulder 222, cone mandrel 202 has a cylindrical surface 224. End cap 208 includes a shoulder 226 operable to limit the extent of downward travel of dual cone assembly 210.

In the illustrated embodiment, lead cone 206 is slidably and sealing disposed around cylindrical surface 224 of cone mandrel 202 and is operable to travel axially along cylindrical surface 224 between shoulder 222 of cone mandrel 202 and shoulder 226 of end cap 208. Lead cone 206 has an outer frustoconical surface 228 with a maximum outer diameter 230 at its upper end. Preferably, outer frustoconical surface 228 has a ramp angle of between about five degrees and about fifteen degrees and most preferably about ten degrees. Note that the ramp angle of outer frustoconical surface 220 is preferably greater than the ramp angle of outer frustoconical surface 228. An upper portion of collapsible cone 204 is slidably disposed around cylindrical surface 218 of cone mandrel 202. A lower portion of collapsible cone 204 is slidably disposed around outer frustoconical surface 220 of cone mandrel 202.

Figure 5:
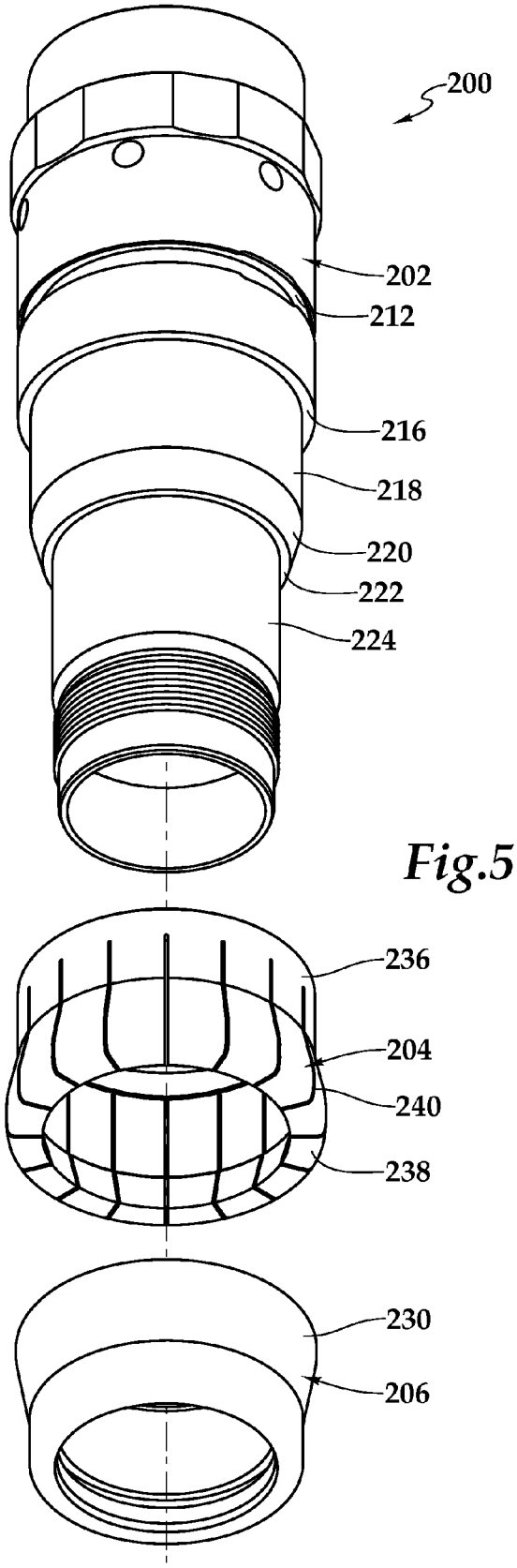
FIG. 5 is an exploded view of an expansion cone assembly for setting a liner hanger in a casing string according to an embodiment of the present invention.

As best seen in FIG. 3, expansion cone assembly 200 is in its run-in and expansion configuration wherein dual cone assembly 210 is in its upper location. In this configuration, collapsible cone 204 has a maximum outer diameter 232 that is larger than maximum outer diameter 230 of lead cone 206. This larger maximum outer diameter 232 is achieved due to the interaction of outer frustoconical surface 220 of cone mandrel 202 and collapsible cone 204. As best seen in FIG. 5, collapsible cone 204 is in the form of a slotted assembly including a solid ring portion 236 and a plurality of radially shiftable segments 238 having slots 240 therebetween. Even though collapsible cone 204 has been depicted as having sixteen radially shiftable segments 238, it should be understood by those skilled in the art that collapsible cones of the present invention could have other numbers of radially shiftable segments both greater than and less than sixteen without departing from the principle of the present invention. Radially shiftable segments 238 are operable to flex radially outwardly or radially inwardly depending upon the force applied thereto. Preferably, in the run-in and expansion configuration of expansion cone assembly 200, outer frustoconical surface 220 of cone mandrel 202 outwardly radially props radially shiftable segments 238 such that maximum outer diameter 232 is larger than a resting maximum outer diameter of collapsible cone 204.

Figure 4:
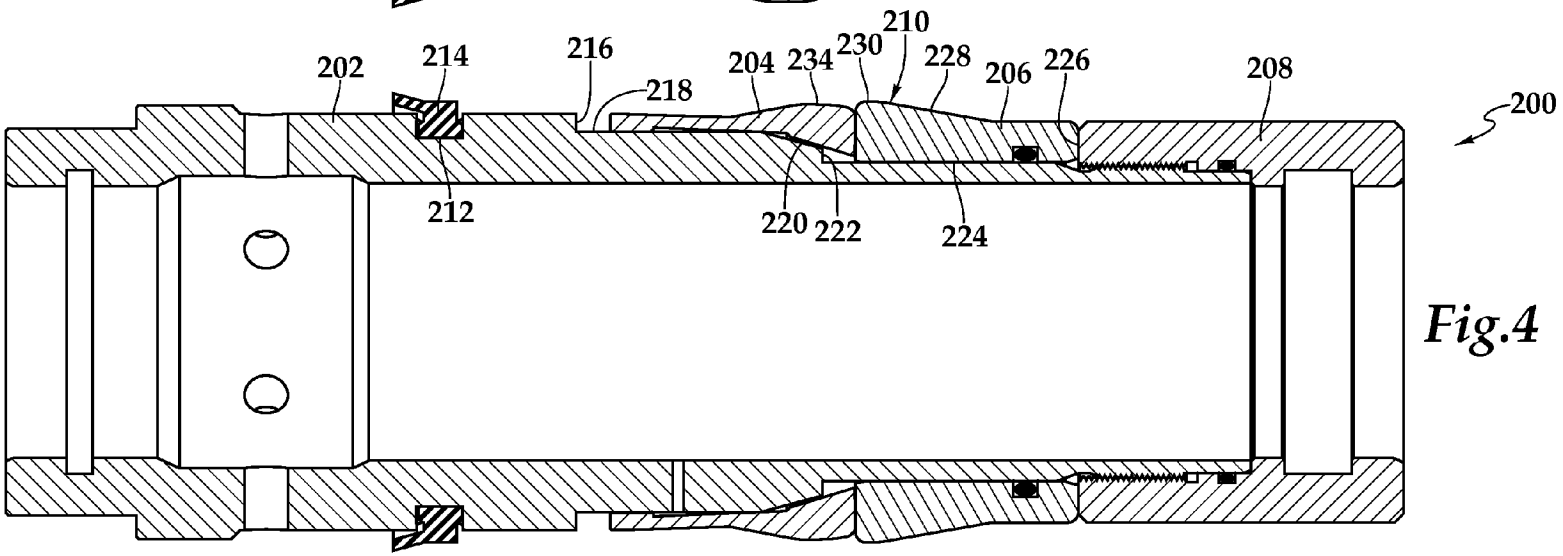
FIG. 4 is a cross sectional view of an expansion cone assembly for setting a liner hanger in a casing string according to an embodiment of the present invention in a second operational configuration.

For example, as best seen in FIG. 4, cone assembly 200 is in its retrieval configuration wherein dual cone assembly 210 is in its lower location. In this configuration, collapsible cone 204 has a maximum outer diameter 234 that is no more than and preferably less than maximum outer diameter 230 of lead cone 206. This smaller maximum outer diameter 234 is achieved as a result of outer frustoconical surface 220 of cone mandrel 202 no longer outwardly radially propping radially shiftable segments 238 of collapsible cone 204. In the unpropped configuration, radially shiftable segments 238 return to their resting configuration resulting in the reduction from maximum outer diameter 232 of collapsible cone 204 to maximum outer diameter 234 of collapsible cone 204.

The operation of expansion cone assembly 200 will now be described. As stated above, during expansion of liner string 102, expansion cone assembly 200 is hydraulically driven downwardly through liner hanger 106. Lead cone 206 provides the first radial expansion force as outer frustoconical surface 228 and maximum outer diameter 230 contact and pass through liner hanger 106 to radially expand and plastically deform liner hanger 106. Following the first radial expansion force, collapsible cone 204 provides a second radial expansion force as maximum outer diameter 232 contacts and passes through liner hanger 106 to further radially expand and plastically deform liner hanger 106. Once expansion cone assembly 200 has completed the expansion process, setting tool 100 may be released from liner string 102, as described above, and setting tool 100 may be pulled uphole. This upward movement of setting tool 100 causes dual cone assembly 110 to shift from its run-in and expansion configuration, as best seen in FIG. 3, to its retrieval configuration, as best seen in FIG. 4. More specifically, collapsible cone 204 axially shifts relative to outer frustoconical surface 220 of cone mandrel 202 such that radially shiftable segments 238 of collapsible cone 204 radially inwardly retract resulting in maximum outer diameter 234 which is no more than and preferably less than maximum outer diameter 230 of lead cone 206. This reduction in the maximum outer diameter of collapsible cone 204 is important as resilience in casing string 40, liner hanger 106 or both may cause a reduction in the inner diameter of liner hanger 106 after setting. The reduction in the maximum outer diameter of collapsible cone 204 enables retrieval of setting tool 100 even after such a reduction of the inner diameter of liner hanger 106.

Figure 6:
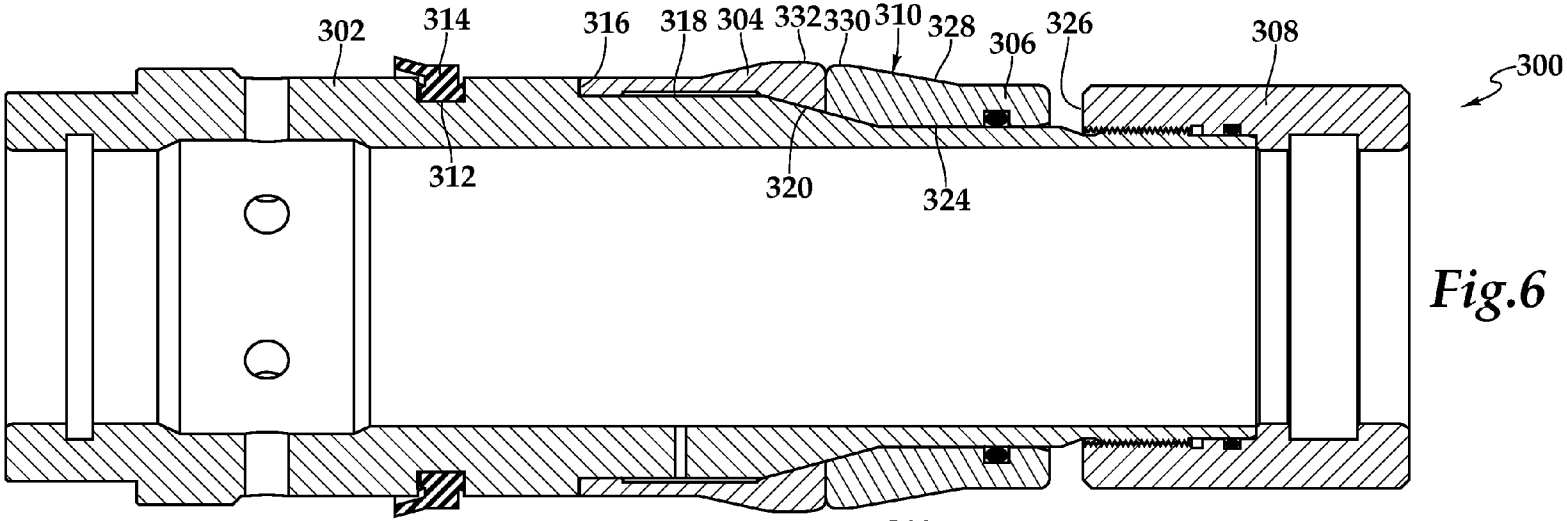
FIG. 6 is a cross sectional view of an expansion cone assembly for setting a liner hanger in a casing string according to another embodiment of the present invention in a first operational configuration.

Referring next to FIG. 6, therein is depicted an expansion cone assembly for setting a liner hanger in a casing string according to another embodiment of the present invention that is generally designated 300. Expansion cone assembly 300 includes a cone mandrel 302, a collapsible cone 304, a lead cone 306 and an end cap 308. As stated above, collapsible cone 304 and lead cone 306 may be referred to as a dual cone assembly 310. Cone mandrel 302 includes a circumferential groove 312 that is operable to receive a debris seal 314 therein. Cone mandrel 302 also includes an upper shoulder 316 operable to limit the extent of upward travel of dual cone assembly 310. Below upper shoulder 316, cone mandrel 302 has a cylindrical surface 318. Below cylindrical surface 318, cone mandrel 302 has an outer frustoconical surface 320. Preferably, outer frustoconical surface 320 has a ramp angle of between about ten degrees and about twenty degrees and most preferably about fifteen degrees. Below outer frustoconical surface 320, cone mandrel 302 has a cylindrical surface 324. End cap 308 includes a shoulder 326 operable to limit the extent of downward travel of dual cone assembly 310.

In the illustrated embodiment, lead cone 306 is slidably and sealing disposed around cylindrical surface 324 of cone mandrel 302 and partially disposed around outer frustoconical surface 320 of cone mandrel 302. Lead cone 306 has an outer frustoconical surface 328 with a maximum outer diameter 330 at its upper end. Preferably, outer frustoconical surface 328 has a ramp angle of between about five degrees and about fifteen degrees and most preferably about ten degrees. Note that the ramp angle of outer frustoconical surface 320 is preferably greater than the ramp angle of outer frustoconical surface 328. An upper portion of collapsible cone 304 is slidably disposed around cylindrical surface 318 of cone mandrel 302. A lower portion of collapsible cone 304 is slidably disposed around outer frustoconical surface 320 of cone mandrel 302.

Figure 7:
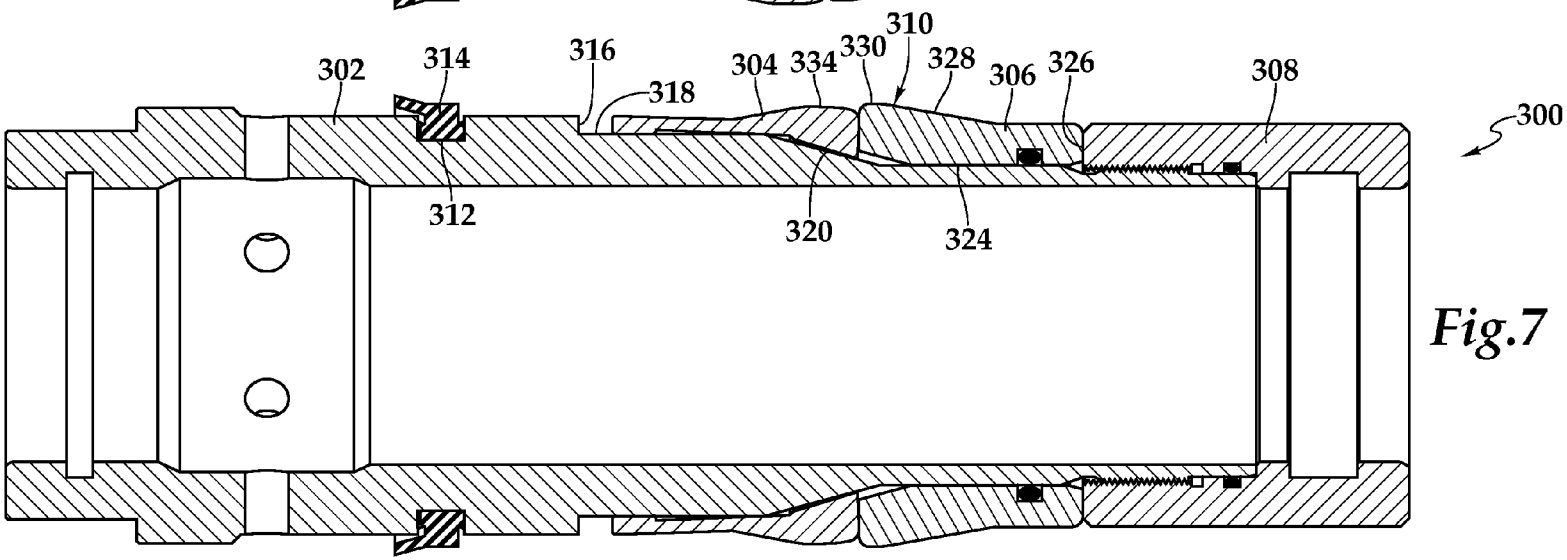
FIG. 7 is a cross sectional view of an expansion cone assembly for setting a liner hanger in a casing string according to another embodiment of the present invention in a second operational configuration.

As best seen in FIG. 6, cone assembly 300 is in its run-in and expansion configuration wherein dual cone assembly 310 is in its upper location. In this configuration, collapsible cone 304 has a maximum outer diameter 332 that is larger than maximum outer diameter 330 of lead cone 306. This larger maximum outer diameter 332 is achieved due to the propping action of outer frustoconical surface 320 of cone mandrel 302 against radially shiftable segments of collapsible cone 304, as described above. As best seen in FIG. 7, cone assembly 300 is in its retrieval configuration wherein dual cone assembly 310 is in its lower location after collapsible cone 304 and lead cone 306 have been axially shifted downwardly. In this configuration, collapsible cone 304 has a maximum outer diameter 334 that is no more than and preferably less than maximum outer diameter 330 of lead cone 306. This smaller maximum outer diameter 334 is achieved as a result of outer frustoconical surface 320 of cone mandrel 202 no longer outwardly radially propping the radially shiftable segments of collapsible cone 304. In the unpropped configuration, the radially shiftable segments return to their resting configuration resulting in the reduction from maximum outer diameter 332 of collapsible cone 304 to maximum outer diameter 334 of collapsible cone 304. This reduction in the maximum outer diameter of collapsible cone 304 is important as resilience in casing string 40, liner hanger 106 or both my cause a reduction in the inner diameter of liner hanger 106 after setting. The reduction in the maximum outer diameter of collapsible cone 304 enables retrieval of setting tool 100 even after such a reduction of the inner diameter of liner hanger 106.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. An expansion cone assembly for setting a liner hanger, the expansion cone assembly comprising:

a cone mandrel having an outer frustoconical surface;

a lead cone slidably disposed around the cone mandrel and having an outer frustoconical surface with a maximum outer diameter; and a collapsible cone slidably disposed at least partially around the outer frustoconical surface of the cone mandrel, the collapsible cone including a solid ring portion without segments having a plurality of radially shiftable segments extending from the solid ring portion, the radially shiftable segments having slots therebetween, wherein, in an expansion configuration, the outer frustoconical surface of the cone mandrel radially props the radially shiftable segments of the collapsible cone such that the collapsible cone has a first maximum outer diameter that is greater than the maximum outer diameter of the lead cone; and wherein, in a retrieval configuration, the collapsible cone axially shifts relative to the outer frustoconical surface of the cone mandrel radially unproping the radially shiftable segments of the collapsible cone such that the collapsible cone has a second maximum outer diameter that is no more than the maximum outer diameter of the lead cone.

2. The expansion cone assembly as recited in claim 1 wherein the cone mandrel has an outer cylindrical surface and wherein the lead cone is slidably disposed at least partially around the outer cylindrical surface of the cone mandrel.

3. The expansion cone assembly as recited in claim 1 wherein the lead cone is slidably disposed at least partially around the outer frustoconical surface of the cone mandrel.

4. The expansion cone assembly as recited in claim 1 wherein the lead cone and the collapsible cone are adjacent to one another.

5. The expansion cone assembly as recited in claim 1 wherein, in an expansion configuration, the outer frustoconical surface of the cone mandrel radially outwardly flexes the radially shiftable segments of the collapsible cone and wherein, in a retrieval configuration, the radially shiftable segments of the collapsible cone are in a radially resting configuration.

6. The expansion cone assembly as recited in claim 1 wherein the lead cone and the collapsible cone axially shift together relative to the outer frustoconical surface of the cone mandrel when the expansion cone assembly is operated from the expansion configuration to the retrieval configuration.

7. The expansion cone assembly as recited in claim 1 wherein the cone mandrel further comprises an end cap that limits axially travel of the lead cone when the expansion cone assembly is operated from the expansion configuration to the retrieval configuration.

8. A method for setting a liner hanger, the method comprising:

operably associating a setting tool having an expansion cone assembly with a liner string including the liner hanger;

lowering the setting tool and the liner string into a wellbore casing;

applying a force in the downhole direction to the expansion cone assembly such that a lead cone and a collapsible cone disposed about a cone mandrel of the expansion cone assembly radially expand at least a portion of the liner hanger into contact with the wellbore casing, the collapsible cone including a solid ring portion without segments having a plurality of radially shiftable segments extending from the solid ring portion, the radially shiftable segments having slots therebetween, an outer frustoconical surface of the cone mandrel radially propping the radially shiftable segments of the collapsible cone such that the collapsible cone has a first maximum outer diameter that is larger than a maximum outer diameter of the lead cone;

decoupling the setting tool from the liner string;

applying a force in the uphole direction to the expansion cone assembly; and axially shifting the lead cone and the collapsible cone relative to the outer frustoconical surface of the cone mandrel radially unproping the radially shiftable segments of the collapsible cone such that the collapsible cone has a second maximum outer diameter that is no more than the maximum outer diameter of the lead cone.

9. The method as recited in claim 8 wherein axially shifting the lead cone and the collapsible cone relative to the outer frustoconical surface of the cone mandrel further comprises axially shifting the lead cone about an outer cylindrical surface of the cone mandrel.

10. The method as recited in claim 8 wherein axially shifting the lead cone and the collapsible cone relative to the outer frustoconical surface of the cone mandrel further comprises axially shifting the lead cone at least partially about the outer frustoconical surface of the cone mandrel.

11. The method as recited in claim 8 wherein radially propping the radially shiftable segments of the collapsible cone further comprises outwardly radially flexing the radially shiftable segments of the collapsible cone.

12. The method as recited in claim 8 further comprising limiting the axial travel of the lead cone and the collapsible cone with an end cap of the expansion cone assembly.

13. An expandable liner hanger system comprising:

a liner string having a liner hanger disposed at an uphole end thereof;

a setting tool operably associate with the liner hanger; and an expansion cone assembly operably associated with the setting tool, the expansion cone assembly including a cone mandrel having an outer frustoconical surface, a lead cone slidably disposed around the cone mandrel and having an outer frustoconical surface with a maximum outer diameter and a collapsible cone slidably disposed at least partially around the outer frustoconical surface of the cone mandrel, the collapsible cone including a solid ring portion without segments having a plurality of radially shiftable segments extending from the solid ring portion, the radially shiftable segments having slots therebetween, wherein, in an expansion configuration, the outer frustoconical surface of the cone mandrel radially props the radially shiftable segments of the collapsible cone such that the collapsible cone has a first maximum outer diameter that is greater than the maximum outer diameter of the lead cone; and wherein, in a retrieval configuration, the collapsible cone axially shifts relative to the outer frustoconical surface of the cone mandrel radially unproping the radially shiftable segments of the collapsible cone such that the collapsible cone has a second maximum outer diameter that is no more than the maximum outer diameter of the lead cone.

14. The expandable liner hanger system as recited in claim 13 wherein the cone mandrel has an outer cylindrical surface and wherein the lead cone is slidably disposed at least partially around the outer cylindrical surface of the cone mandrel.

15. The expandable liner hanger system as recited in claim 13 wherein the lead cone is slidably disposed at least partially around the outer frustoconical surface of the cone mandrel.

16. The expandable liner hanger system as recited in claim 13 wherein, in an expansion configuration, the outer frustoconical surface of the cone mandrel radially outwardly flexes the radially shiftable segments of the collapsible cone and wherein, in a retrieval configuration, the radially shiftable segments of the collapsible cone are in a radially resting configuration.

17. The expandable liner hanger system as recited in claim 13 wherein the lead cone and the collapsible cone axially shift together relative to the outer frustoconical surface of the cone mandrel when the expansion cone assembly is operated from the expansion configuration to the retrieval configuration.

18. The expandable liner hanger system as recited in claim 13 wherein the cone mandrel further comprises an end cap that limits axially travel of the lead cone when the expansion cone assembly is operated from the expansion configuration to the retrieval configuration.

* * * * *